US007657219B2

(12) United States Patent
Taniguchi et al.

(10) Patent No.: US 7,657,219 B2
(45) Date of Patent: Feb. 2, 2010

(54) IMAGE FORMING APPARATUS

(75) Inventors: Tadasu Taniguchi, Uda (JP); Norichika Katsura, Tenri (JP); Masahiko Fujita, Nara (JP); Yasuaki Fukuda, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 301 days.

(21) Appl. No.: 11/467,207

(22) Filed: Aug. 25, 2006

(65) Prior Publication Data

US 2007/0092320 A1 Apr. 26, 2007

(30) Foreign Application Priority Data

Oct. 6, 2005 (JP) ..... 2005-293787

(51) Int. Cl.
*G03G 15/00* (2006.01)

(52) U.S. Cl. ..... 399/381; 399/407

(58) Field of Classification Search ..... 399/397, 399/407; 101/420

See application file for complete search history.

(56) References Cited

U.S. PATENT DOCUMENTS 5,613,179 A * 3/1997 Carter et al. ..... 399/316

FOREIGN PATENT DOCUMENTS

| | | | |
|---|---|---|---|
| JP | 06-001514 | | 1/1994 |
| JP | 06001514 | A2 * | 1/1994 |
| JP | 08-091625 | | 4/1996 |
| JP | 10077149 | A * | 3/1998 |
| JP | 10279122 | A * | 10/1998 |
| JP | 2001-315993 | | 11/2001 |
| JP | 2001322735 | A * | 11/2001 |
| JP | 2005-059977 | | 3/2005 |
| JP | 2005-138966 | | 6/2005 |

* cited by examiner

*Primary Examiner*—Judy Nguyen
*Assistant Examiner*—Allister Primo
(74) *Attorney, Agent, or Firm*—Renner, Otto, Boiselle & Sklar, LLP

(57) ABSTRACT

An image forming apparatus including: a paper feed cassette; a paper pickup roller; an image forming portion; a fixing unit; a paper discharge portion for discharging paper P with a developer image fused and fixed thereon; and an inversion roller and a paper discharge drive roller for conveying paper P along a paper conveyance path, and is constructed such that guide ribs are provided for a curved portion in a main conveyance path and the first and second curved portions of a sub conveyance path are provided in shapes that will not cause concentration of stress acting on the paper P in abutment.

21 Claims, 8 Drawing Sheets

IMAGE FORMING APPARATUS

This Nonprovisional application claims priority under 35 U.S.C. §119(a) on Patent Application No. 2005-293787 filed in Japan on 6 Oct. 2005, the entire contents of which are hereby incorporated by reference.

BACKGROUND OF THE INVENTION (1) Field of the Invention

The present invention relates to an image forming apparatus, in particular relating to an image forming apparatus which outputs image information that is electrophotographically visualized on a recording medium with a developer.

(2) Description of the Prior Art

Recently, an image forming apparatus is typically provided as a so-called multi-functional machine which can provide a plurality of functions such as copier, printer, facsimile and other functions, with a single configuration.

In the field of such image forming apparatus, the mainstream of the machines is the so-called front access type that includes: a document reading portion for reading originals disposed at the top of the machine; an image forming portion disposed on one side with respect to the center for forming a developer image based on the captured image information; a paper feed portion disposed at the bottom for storing multiple sheets of paper; and a paper output portion (paper output tray) arranged in the space formed in the center, to which paper with image information recorded thereon is discharged.

In such image forming apparatuses, the paper conveyance path from the paper feed means to the paper discharge means is constructed with a combination of linear and curved sections, so as to be able to achieve a compact design.

Of the image forming apparatus of the above kind, there is a known configuration in which, in order to enable correct conveyance of paper in the machine, the paper conveyance path is provided with guide components that guide the paper to be conveyed (see Japanese Patent Application Laid-open 2001-315993).

However, in an image forming apparatus in which the paper conveyance path is constructed of a complex arrangement of linear and curved sections as described above, there occurs the so-called "rubbing phenomenon", that is, stress concentration acting on the paper during paper conveyance by the combination of conveying rollers and paper guide components in the curved paper conveyance path.

In particular, if such a phenomenon occurs in the paper discharge means after image information has been fixed to the paper, the image of information on the paper (in a state where the developer is still warm immediately after fixing) is rubbed by the paper guide components, causing the problem that the print quality is degraded.

Further, if this situation continues, there occurs the problem that the paper might skew or jam in the course of the curved paper conveyance path.

SUMMARY OF THE INVENTION

In view of the above conventional problems, it is therefore an object of the present invention to provide an image forming apparatus, which is able to achieve correct paper conveyance by suppressing degradation of print quality due to the rubbing phenomenon which occurs during paper conveyance after image information has been fixed thereon and also by preventing skew and jamming during paper conveyance.

In order to solve the above problems, the image forming apparatus according to the present invention is configured as follows.

An image forming apparatus according to the first aspect of the present invention includes: a recording medium container for holding a multiple number of recording mediums; a recording medium feeder for delivering the recording mediums, sheet by sheet, from the recording medium container; an image forming portion for transferring a developer image formed with a developer to the recording medium; a fixing portion for fusing and fixing the developer image transferred to the recording medium onto the recording medium by a heated fixing roller; a paper discharge portion for discharging the recording medium with the developer image fused and fixed thereon to the outside of the apparatus; and, a recording medium conveying portion for conveying the recording medium along a recording medium conveyance path by conveyance rollers, and is characterized in that the recording medium conveyance path is formed with guide components for guiding the conveyed recording medium in the recording medium's direction of conveyance; the guide components are provided at least inside a curved part of the recording medium conveyance path; and the guide components are formed in shapes that will not cause concentration of stress acting on the recording medium in abutment therewith.

An image forming apparatus defined in the second aspect of the present invention is characterized in that, in addition to the configuration described in the first aspect, the recording medium conveying portion includes conveyance rollers arranged across the guide components, on the upstream and downstream sides thereof, with respect to the recording medium's direction of conveyance, and the two conveyance rollers are arranged at such positions as to be able to hold and convey the recording medium at the same time.

An image forming apparatus defined in the third aspect of the present invention is characterized in that, in addition to the configuration described in the first or second aspect, the guide component is constructed such that, as to the configuration in the width direction that is perpendicular to the recording medium's direction of conveyance, a section of the guide component is formed to be wider at an area where a greater concentration of stress acts on the recording medium being conveyed while a section of guide component is formed to be narrower at an area where a less concentration of stress acts on the recording medium being conveyed.

An image forming apparatus defined in the fourth aspect of the present invention is characterized in that, in addition to the configuration described in any one of the first through third aspects, the guide component provided inside the curved part of the recording medium conveyance path is formed so that it is formed to be wider in the middle portion of the curved part with respect to the recording medium's direction of conveyance while it is formed to be narrower in the distal ends of the curved part with respect to the recording medium's direction of conveyance.

An image forming apparatus defined in the fifth aspect of the present invention is characterized in that, in addition to the configuration described in any one of the first through fourth aspects, the conveyance roller is composed of a multiple number of conveyance roller pieces, separated with respect to the direction perpendicular to the recording medium's direction of conveyance, and the guide components are disposed correspondingly to the separated conveyance roller pieces.

An image forming apparatus defined in the sixth aspect of the present invention is characterized in that, in addition to the configuration described in any one of the first through fifth aspects, the guide components are arranged in a curved part of the recording medium conveyance path between the fixing portion and the paper discharge portion.

An image forming apparatus defined in the seventh aspect of the present invention, in addition to the configuration described in any one of the first through sixth aspects, has a duplex printing function, further includes: as a component of the recording medium conveyance path a sub conveyance path for conveying the recording medium by switchback control when duplex printing is performed, and is characterized in that the sub conveyance path is extended from the fixing portion to the image forming portion; and the guide components are arranged in a curved part of the sub conveyance path.

In accordance with the first aspect of the present invention, the image forming apparatus includes: a recording medium container for holding a multiple number of recording mediums; a recording medium feeder for delivering the recording mediums, sheet by sheet, from the recording medium container; an image forming portion for transferring a developer image formed with a developer to the recording medium; a fixing portion for fusing and fixing the developer image transferred to the recording medium onto the recording medium by a heated fixing roller; a paper discharge portion for discharging the recording medium with the developer image fused and fixed thereon to the outside of the apparatus; and, a recording medium conveying portion for conveying the recording medium along a recording medium conveyance path by conveyance rollers, and is constructed such that the recording medium conveyance path is formed with guide components for guiding the conveyed recording medium in the recording medium's direction of conveyance; the guide components are provided at least inside a curved part of the recording medium conveyance path; and the guide components are formed in shapes that will not cause concentration of stress acting on the recording medium in abutment therewith. This configuration makes it possible to suppress the rubbing phenomenon due to paper conveyance after image information has been fixed to the paper, hence prevent degradation of print quality. It is also possible to prevent skew and jamming during paper conveyance, thus achieving correct paper conveyance.

In accordance with the inventions according to the second to seventh aspects of the present invention, the following effects can be obtained in addition to the above common effect which can be obtained from the first aspect of the invention.

That, in accordance with the second aspect of the present invention, inclusion of conveyance rollers arranged across the guide components, on the upstream and downstream sides thereof, with respect to the recording medium's direction of conveyance, and arrangement of the two conveyance rollers at such positions as to be able to hold and convey the recording medium at the same time, makes it possible to achieve correct conveyance by holding and conveying the recording medium to be conveyed by the two conveyance rollers.

In accordance with the third aspect of the present invention, since the guide component is constructed such that, as to the configuration in the width direction that is perpendicular to the recording medium's direction of conveyance, a section of the guide component is formed to be wider at an area where a greater concentration of stress acts on the recording medium being conveyed while a section of guide component is formed to be narrower at an area where a less concentration of stress acts on the recording medium being conveyed, areas on the paper where a strong concentration of stress takes place can be dispersed by bearing the load with a greater area of surface contact, so that it is possible to suppress the "rubbing phenomenon" by alleviating the load acting on the recording medium.

In accordance with the fourth aspect of the present invention, since the guide component provided inside the curved part of the recording medium conveyance path is formed so that it is formed to be wider in the middle portion of the curved part with respect to the recording medium's direction of conveyance while it is formed to be narrower in the distal ends of the curved part with respect to the recording medium's direction of conveyance, the stress acting on the area in the middle of the curvature where concentration of stress is maximized can be dispersed by bearing the load with a greater area of surface contact, so that it is possible to alleviate the load acting on the recording medium.

In accordance with the fifth aspect of the present invention, since the conveyance roller is composed of a multiple number of conveyance roller pieces, separated with respect to the direction perpendicular to the recording medium's direction of conveyance, and the guide components are disposed correspondingly to the separated conveyance roller pieces, use of the separate conveyance roller pieces makes it possible to disperse concentration of stress acting on the recording medium, hence it is possible to make the stress acting on the recording medium as uniform as possible and alleviate stress concentration.

In accordance with the sixth aspect of the present invention, the guide components are arranged in a curved part of the recording medium conveyance path between the fixing portion and the paper discharge portion, so that it is possible to alleviate concentration of stress acting on the recording medium during conveyance after the image information has been fixed thereon and suppress degradation of print quality of image information, caused by being rubbed by the guide components.

In accordance with the seventh aspect of the present invention, since that apparatus has a duplex printing function, and further includes: as a component of the recording medium conveyance path a sub conveyance path for conveying the recording medium by switchback control when duplex printing is performed, and is characterized in that the sub conveyance path is extended from the fixing portion to the image forming portion; and the guide components are arranged in a curved part of the sub conveyance path, it is possible to alleviate concentration of stress acting on the recording medium during conveyance after the image information has been fixed thereon and suppress degradation of print quality of image information, caused by being rubbed by the guide components.

DESCRIPTION OF THE PREFERRED EMBODIMENTS

The embodiment of the present invention will hereinafter be described in detail with reference to the drawings.

Figure 1:
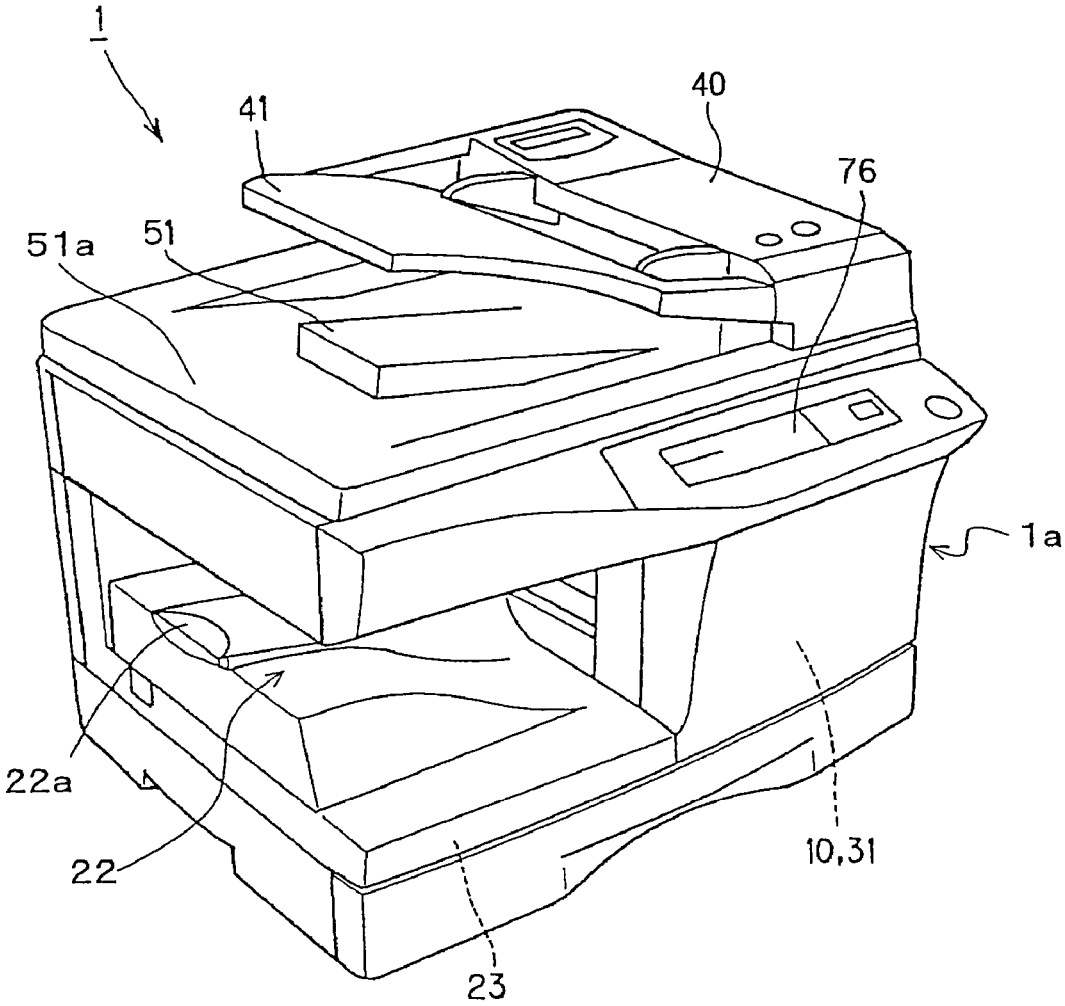
FIG. 1 is a perspective view showing an overall configuration of an image forming apparatus according to the embodiment of the present invention.
Figure 2:
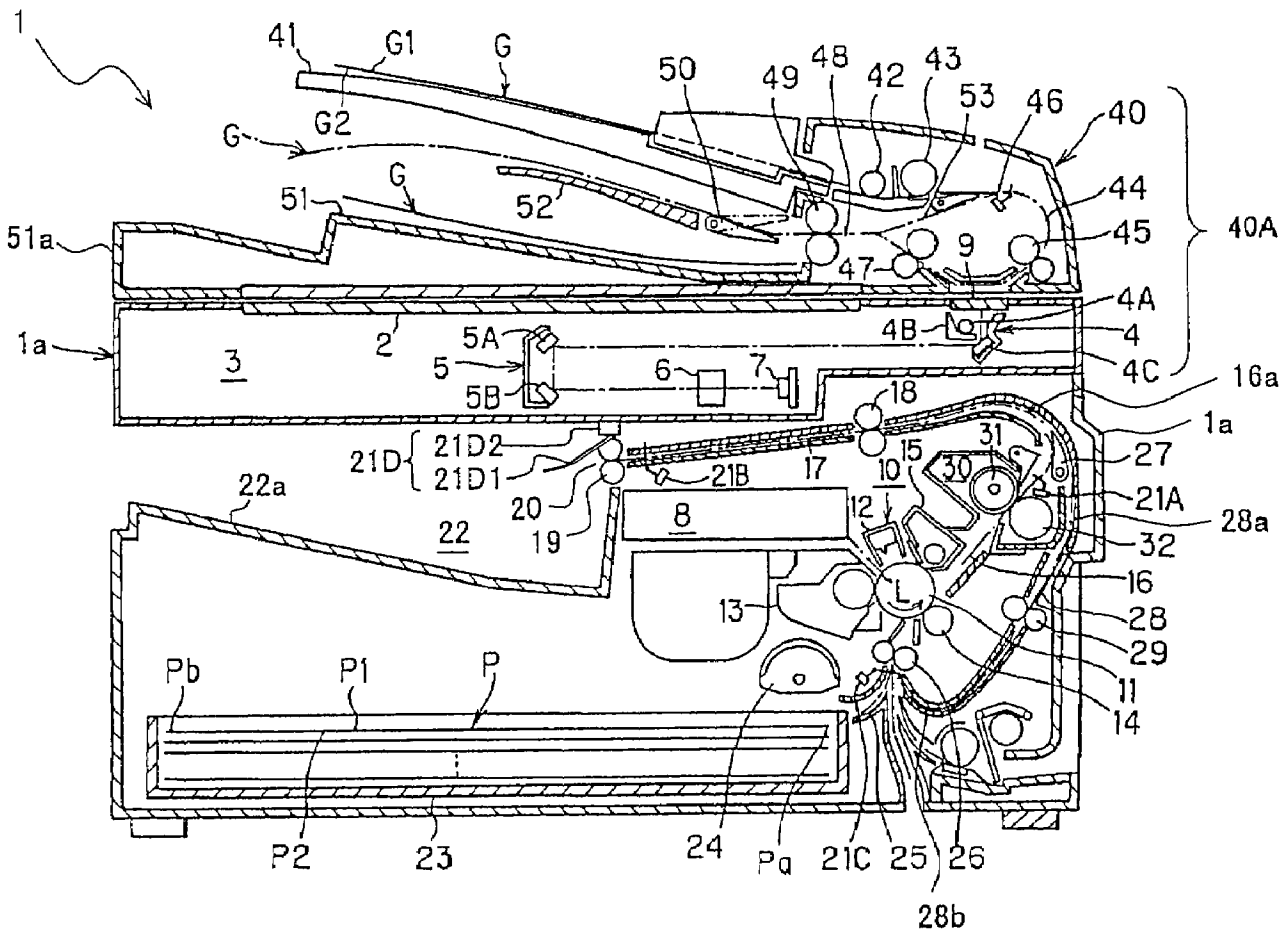
FIG. 2 is a sectional side view showing an internal configuration of the image forming apparatus.

FIGS. 1 and 2 shows one example of the embodiment of the present invention, FIG. 1 is a perspective view showing the overall configuration of an image forming apparatus according to one embodiment of the present invention, and FIG. 2 is a sectional side view showing the internal configuration of the image forming apparatus.

An image forming apparatus 1 according to the present embodiment includes a document reader 40A (FIG. 2) for reading image information from an original G (FIG. 2), and outputs the image information of original G, captured by the document reader 40A, by electrophotographically forming a monochrome image on a predetermined sheet of recording paper (to be referred to hereinbelow as the paper) as a recording medium.

To begin with, the overall configuration of image forming apparatus 1 according to the present embodiment will be described with reference to the drawings.

As shown in FIGS. 1 and 2, image forming apparatus 1 is provided with an original placement table (platen glass) 2 (FIG. 2) of transparent glass on which original G is placed, on the top of an apparatus body 1*a*.

There is an automatic document processor 40 on the top of this original placement table 2 while a scanner portion 3 (FIG. 2) as an image reader for reading image information from original G is laid out under this original placement table 2.

The original placement table 2, scanner portion 3 and automatic document processor 4 and others constitute a document reader 40A (FIG. 2).

Arranged under scanner portion 3 (FIG. 2) are an image forming portion 10 (FIG. 2), a fixing unit (fixing portion) 30 (FIG. 2) and a paper output portion 22. Provided further below is a paper feed cassette 23 which stores recording paper as recording media.

As shown in FIG. 2, scanner portion 3 is composed of an original image reading unit that includes a first scanner unit 4 and a second scanner unit 5, which are arranged under original placement table 2 and move reciprocatively in parallel therewith, an optical lens element 6 and a photoelectric transducer (CCD) 7.

In FIG. 2, the light path in the scanner portion 3 is represented by the chain line.

First scanner unit 4 includes: an exposure lamp 4A; a reflector 4B for illuminating the original image surface with light from this exposure lamp 4A; and a first mirror 4C for leading the light image reflected off the original that is exposed by light from the reflector 4B in a predetermined direction, and is controlled so as to move back and forth at a predetermined scan speed, keeping itself parallel to and a predetermined distance from, the underside of original placement table 2.

Second scanner unit 5 includes a second mirror 5A and a third mirror 5B for further directing the light image from the original by way of first mirror 4C of first scan unit 4 in a predetermined direction and is controlled so as to move back and forth parallel to, and at a speed related to the speed of, the first scan unit 4.

Optical lens element 6 is disposed on the optical path of the light that is reflected off the original image and deflected by third mirror 5B of second scan unit 5 so that the light image is focused on photoelectric transducer 7.

Figure 4:
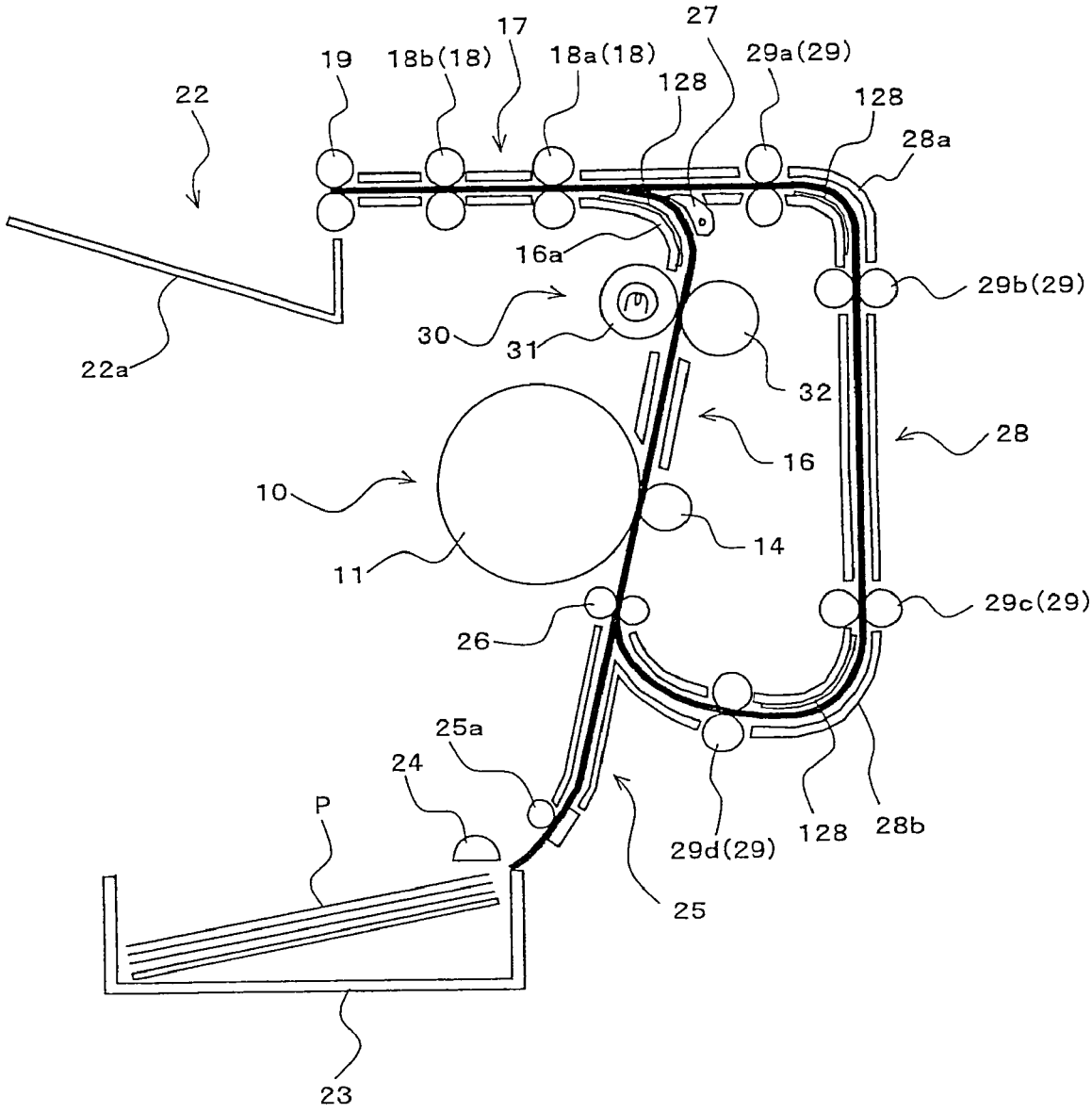
FIG. 4 is a schematic diagram showing a configuration of one example of a paper conveyance path for the image forming apparatus.

The photoelectric transducer (e.g., CCD (charge coupled device)) 7 reads the light image of the original image that is focused by optical lens element 6 and photoelectrically converts it into electric signals to thereby create original image information (original image data) and outputs the original image information to an aftermentioned image processor 57 (FIG. 4).

Image processor 57 subjects the original image information output from photoelectric transducer 7 to image processes and produces printing image information (printing image data) so that the resolution, density, etc., will be suited for printing. The print image information obtained as a result of the image processes is transferred to an image data input portion of a laser scanning unit (LSU) 8 (FIG. 2).

Laser scanning unit 8 emits laser beams in accordance with the printing image information output from image processor 57 to illuminate the surface of a photoreceptor drum 11 (FIG. 2) as a constituent of image forming portion (image forming process) 10. Thereby, an electrostatic latent image of the printing image information is written on photoreceptor drum 11.

As shown in FIG. 2, image forming portion 10 is mainly comprised of photoreceptor drum 11 driven to rotate in the direction of an arrow, a main charger 12 for electrifying the photoreceptor drum 11 surface at a predetermined potential, laser scanning unit 8 for illuminating the photoreceptor drum 11 surface with laser beams for forming an electrostatic latent image, a developing unit 13 for visualizing the electrostatic latent image formed by irradiation of the laser beams from the laser scanning unit 8, with toner, a transfer roller 14 for transferring the toner image of the original image visualized by the developing unit 13 to the paper (corresponding to "recording medium": also called "print paper") P that is fed from an aftermentioned paper feed cassette 23 through a paper feed path 25, and a cleaning unit 15 for cleaning the leftover toner remaining on the photoreceptor drum 11 after transfer by the transfer roller 14, all these elements being arranged in the order mentioned along the photoreceptor drum 11 in its rotational direction.

Main charger 12 of image forming portion 10 also has the function of an unillustrated charge erasing device for erasing electricity on the photo receptor drum 11 surface after cleaning by cleaning unit 15.

Fixing unit 30 has a heat roller 31 and a pressing roller 32 as shown in FIG. 2, and fuses the toner image transferred on paper P and fixes the toner image to paper P as the paper P is passed through and between heat roller 31 and pressing roller 32 by rotating heat roller 31 while the paper P being nipped between the heat roller 31 and pressing roller 32.

The paper P with a toner image transferred thereon as it being nipped between photoreceptor drum 11 and transfer roller 14 is separated from photoreceptor drum 11 and conveyed along a main conveying path 16 that connects the photoreceptor drum 11 and fixing unit 30 into and between heat roller 31 and pressing roller 32 of the fixing unit 30. Heat roller 31 and pressing roller 32 abut each other with a predetermined pressing force, forming a nip portion at that contact.

In fixing unit 30, the paper P held between heat roller 31 and pressing roller 32, i.e., at the nip portion, is heated by heat roller 31 and pressed by pressing roller 32, so that the unfixed toner image that has been transferred from the photoreceptor drum 11 is fixed to the paper P.

The paper P after the fixing by fixing unit 30 is conveyed to paper discharge path 17 and further conveyed by a paper discharge drive roller 18 toward a paper discharge roller 19 on the paper discharge port 20 side.

The passage status of paper P being conveyed into paper discharge path 17 is detected by a fixing detection switch 21A arranged downstream of fixing unit 30 when the paper P passes by the nip between heat roller 31 and pressing roller 32.

For a case of usual one-sided printing, the paper is directly conveyed by the rotational drives of paper discharge drive roller 18 and paper discharge roller 19 and discharged through paper discharge port 20 onto a paper output tray 22*a* which is disposed in a space under scanner portion 3. The passage status of paper P through paper discharge roller 19 is adapted to be detected by a paper discharge detecting switch 21B arranged upstream of paper discharge roller 19.

Paper P is discharged to the side of the image forming portion 10 and the discharged paper P is output over cassette 23 and under scanner portion 3.

Arranged at the inner bottom of main apparatus body 1*a* is an exchangeable paper feed cassette 23, in which a stack of recording paper P of a predetermined paper size is accommodated. A crescent-shaped sheet pickup roller 24 is arranged over the paper delivering side of this paper feed cassette 23.

This paper pickup roller 24 picks up the paper, sheet by sheet, from the topmost of a stack of paper P in paper feed cassette 23 and conveys the paper downstream (for convenience, the delivery side of recording paper P (the cassette side) is referred to as upstream and the direction of conveyance is referred to as downstream) to a registration roller (also called "idle roller") 26 in paper feed path 25.

A reference numeral Pa in the drawing designates the front end of paper P and Pb designates the rear end of paper P.

Arranged on the upstream side of registration roller 26 is a pre-registration detection switch 21C. This pre-registration detection switch 21C detects paper P that is fed and conveyed from paper feed cassette 23. Paper feed to the aforementioned image forming portion 10 is adapted to be performed by adjusting the paper feed timing based on this signal.

In the case where duplex printing is performed, after printing by image forming portion 10 has been performed on one side of paper P, the paper P is sent into paper discharge path 17 after passage through fixing unit 30, then once conveyed to the paper discharge roller 19 side. In this condition, a paper path switching gate 27 that is disposed near fixing unit 30 is changed over, then paper discharge roller 19 is driven in reverse so that the paper P is switched back and guided into sub conveyance path 28 for reversing the paper. Then, the thus guided paper P is rotationally driven by a sub-drive roller (inversion roller (feed roller)) 29 provided on this sub conveyance path 28 and conveyed to the upstream side of registration roller 26 once again, so that printing on the other side of paper P is performed.

On original placement table 2 of main apparatus body 1*a* an automatic document processor 40 of a document feed type reversing automatic document feeder (R-SPF) integrated with an original presser (original pressing cover) 51*a* is mounted in an openable manner, constituting document reader 40A in combination with scanner portion 3.

Document reader 40A is constructed so as to be able to perform an original reading operation for an individual document in the same control manner as in the conventional apparatus, and provision of automatic document processor 40 makes it possible to perform double-sided reading of original G and also perform automatic sequential reading of a multiple number of originals G.

As shown in FIG. 2, automatic document processor 40 has a document tray 41 on which originals G are set. When a multiple number of originals G are sequentially read, the originals G set on this document tray 41 are picked up, one by one, by a document pickup roller 42 so that original G is guided by a document drive roller 43 through a document conveyance path 44 and conveyed to the upstream side of a registration roller (PS roller) 45.

Provided on the upstream side of this registration roller 45 is a document input sensor 46 for enabling detection of the document size of original G. This document input sensor 46 detects the leading and trailing edges of original G, so that based on the detected signals, the original G can be controlled and conveyed to an original reading station 9 of a glass slit located adjacent to one side of original placement table 2, taking into account the timing of delivery.

In this case, first scanner unit 4 of scanner portion 3 has been controlled and moved so that it is positioned under document reading station 9 for standby.

As to the scan of original G that is conveyed over this document reading station 9, one side of the original, namely, the first image-scan side G1 is scanned by first scan unit 4 of scanner portion 3 while the original is being moved. Other operations such as image reading by photoelectric transducer 7, image processing of image information, image forming including printing etc., are performed in the same manner as above.

The original G that has been scanned through document reading station 9 is then conveyed by a conveyance roller 47 through a document discharge path 48 toward the document discharge roller 49 side. When document reading is performed for one side only, the document is discharged onto a document output tray 51 by the switching control of a document switching gate 50.

When document reading is performed for both sides, by the switching control of document switching gate 50 original G is once discharged onto a middle tray 52 disposed between document tray 41 and document output tray 51, then is switched back into a document reversing path 53 by driving document discharge roller 49 in reverse. Then the original G is once again fed into document conveyance path 44 so that the original image on the underside of original G, namely the side G2 facing the image reader is scanned while the original image on the underside of original G is printed out on the first printing side P1 of paper P in the same manner as in the above-described one-side printing operation.

When this printing operation for the first printing side P1 of paper P has been finished, paper P is reversed by the above-described sheet reversing device, then fed again into image forming portion 10 so that the original image on the front side of original G that has been previously stored in the memory is printed on the second printing side P2.

As shown in FIG. 1, control switches 76 for allowing the user to set up the image forming conditions such as the sheet type of paper P (sheet thickness etc., in addition to sheet size), print number, magnification, density etc., are arranged on the front portion on the upper side of main apparatus body 1*a* of image forming apparatus 1.

Paper output portion 22 is mainly comprised of paper discharge path 17, paper discharge drive roller 18, paper discharge roller 19, paper discharge port 20 and paper output tray 22*a*.

Arranged on the outer side of paper discharge port 20 (on the paper output tray 22*a* side) is a paper stack quantity detecting sensor 21D, also called a full stack detecting sensor.

Paper stack quantity detecting sensor 21D is mainly composed of a detecting piece 21D1 which operates when the paper discharged and stacked abuts the detecting piece, and a sensor body 21D2 which outputs a signal in accordance with the operation of detecting piece 21D1.

Detecting piece 21D1 has a rod-shaped configuration with its one end engaged with the sensor body 21D2 side so that the other end side can pivot on the first end, and the piece is arranged obliquely downward and outward from the apparatus side (paper discharge port 20 side).

With this structure, paper stack quantity detecting sensor 21D is adapted to output a detection signal from sensor body 21D2 as the second end of detecting piece 21D1 is pushed upward when the discharged amount of stacked paper has reached a predetermined amount (height).

Figure 3:
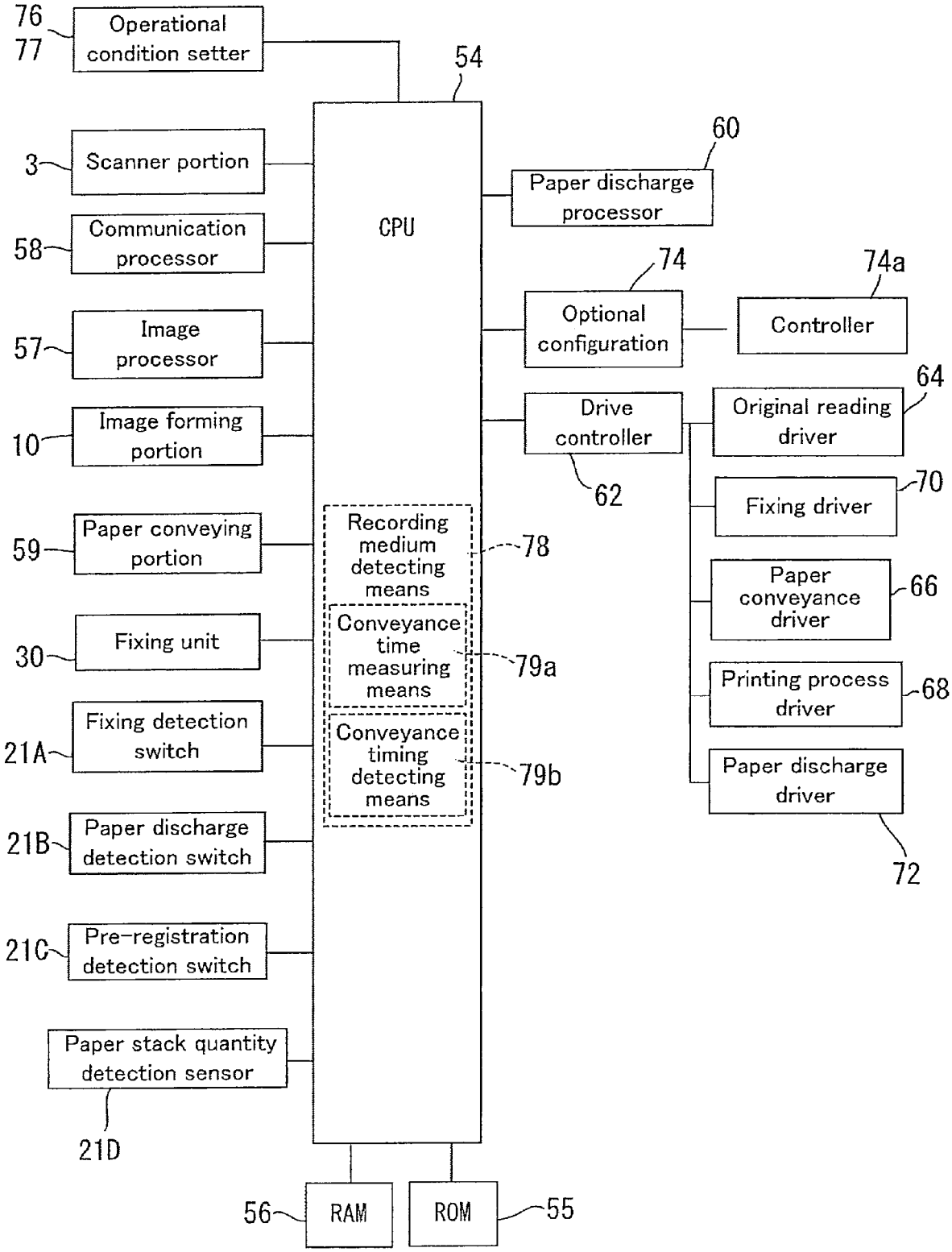
FIG. 3 is a block diagram showing a configuration of an electric controller of the image forming apparatus.

Referring next to FIG. 3, the control system of image forming apparatus 1 according to the embodiment will be described.

FIG. 3 is a block diagram showing an electric controller configuration of the image forming apparatus according to the present embodiment.

As shown in FIG. 3, image forming apparatus 1 according to the embodiment performs processes such as image reading, image processing, image forming and conveyance of paper P, etc., by a central processing unit (CPU) 54 which performs control in accordance with the program stored beforehand in ROM (read only memory) 55, using temporal storage such as RAM (random access memory) 56 etc. It is also possible to use other storage such as a HDD (hard disk drive) etc., instead of ROM and RAM.

In image forming apparatus 1, the image information of an original (original image data) captured by scanner portion (original reading portion) 3, or original image information transmitted from other terminal devices connected via an unillustrated communication network, is adapted to be input to image processing portion 57 by way of a communication processor 58.

Image processor 57 shapes the original image information stored in the storage such as RAM 56 or the like into a printing image that is suitable for printing (image forming onto paper), in accordance with the aforementioned program.

The printing image information is input to image forming portion 10.

Image forming portion 10, paper conveying portion (performing various detentions and controls of paper P in paper feed path 25, main conveyance path 16, sub conveyance path 28 in FIG. 2 (these are also called paper guides)) 59, fixing unit 30 and paper discharge processor (performing various detentions and controls of paper P in paper discharge path 17(FIG. 2)) 60 are linked with respective drive controllers 62.

Paper conveying portion 59 conveys paper P through the printing stage (image information is printed in image forming portion 10) and the fixing stage where the paper P having been processed with printed information is fixed (in fixing unit 30) and then discharges the sheet to paper discharge portion (paper output tray 22*a*).

Here, paper conveying portion 59 receives detection signals from fixing detection switch 21A, paper discharge detecting switch 21B, pre-registration detection switch 21C etc.

Image forming apparatus 1 has an operational condition setter 77. This operational condition setter 77 sets up operational conditions for image forming and conditions of conveyance etc., in image forming apparatus 1, in accordance with the image forming request and the image forming conditions such as the type of recording media etc., designated by the user through control switches 76 (FIG. 1).

Further, in image forming apparatus 1, based on the set operating conditions, drive controller 62 is adapted to control drive actuators for the aforementioned reading portion (scanner portion 3), paper conveying portion 59, image forming portion 10, fixing unit 30, paper discharge processor 60 etc., namely, an original reading driver 64, a paper conveyance driver 66, a printing process driver 68, a fixing driver 70 and a paper discharge driver 72 so that they can operate in synchronization with instructions from CPU 54 in accordance with the program stored in ROM 55.

Paper discharge processor 60 makes control of a paper discharge process of discharging the printed paper to the paper output tray and performs the paper discharge process based on the signal output from paper stack quantity detecting sensor 21D.

Original reading driver 64 is a drive actuator for the first scan unit 4 and the second scan unit 5 of scanner portion 3.

Paper conveyance driver 66 means paper conveying portion 59, specifically, drive motors for paper pickup roller 24 and registration roller 26 along the aforementioned paper feed path 25.

Printing process driver 68 is a drive motor for photoreceptor drum 11.

Fixing driver 70 includes drive motors for heat roller 31 and pressing roller 32 in fixing unit 30.

Paper discharge driver 72 includes drive motors for paper discharge drive roller 18, paper discharge roller 19 etc.

All these drive motors of the drivers may be configured of common or different motors as driving source with appropriate power transmission mechanisms.

Further, image forming apparatus 1 may be used with optional configurations 74 including automatic document processor (automatic document reader) 40 (FIGS. 1 and 2) etc. These optional configurations 74 incorporate individual controllers 74*a* separately from the controller of the image forming apparatus 1 so as to operate in synchronization with the main apparatus by performing timing adjustment via the aforementioned communication processor 58.

A recording medium detecting means 78 detects arrival of the leading end of the recording medium at fixing unit 30 or the discharge portion.

Recording medium detecting means 78 is adapted to detect the timings at which the paper P arrives at (enters) fixing unit 30 and paper discharge drive roller 18 (FIG. 2) based on the conveyance timing of the recording medium detected by an aftermentioned conveyance timing detecting means 79*b*.

Specifically, recording medium detecting means 78 includes: a conveyance time measuring means 79*a* for measuring the time of conveyance of paper P from when the paper is delivered from registration roller 26 (FIG. 2) at the entrance of paper feed path 25 (FIG. 2) where the paper is introduced; and a conveyance timing detecting means 79*b* for detecting the timings at which paper P is conveyed in main conveying path 16 and in paper discharge path 17, based on the distances from registration roller 26 to fixing unit 30 (FIG. 2) and discharge drive roller 18 (FIG. 2) to be controlled, and the paper's speed of conveyance.

Next, a specific example of a paper conveyance path configuration for the image forming apparatus of the present embodiment will be described.

Figure 5:
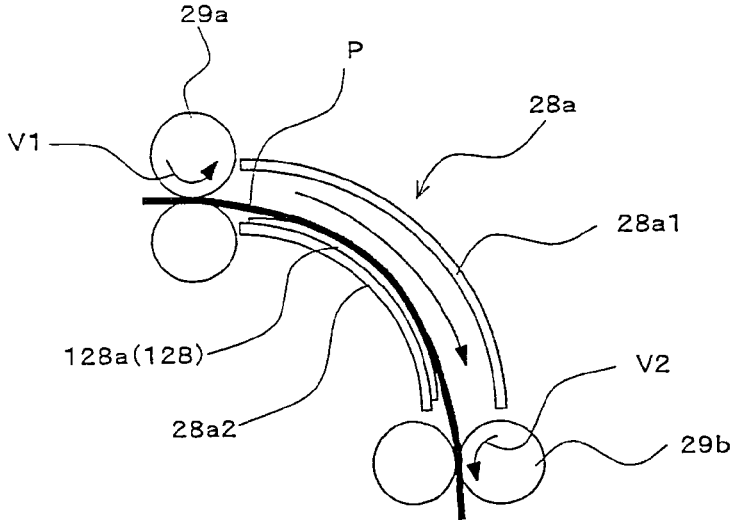
FIG. 5 is a side view showing a first curved part and inversion rollers in the paper conveyance path.
Figure 6:
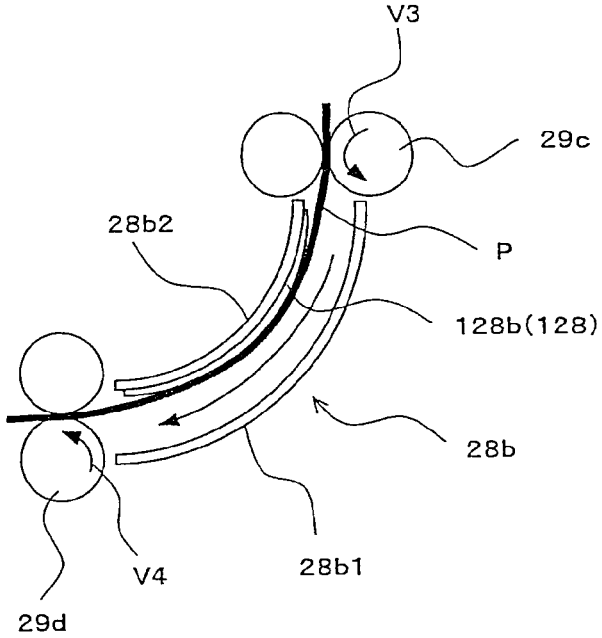
FIG. 6 is a side view showing a second curved part and inversion rollers in the paper conveyance path.
Figure 7:
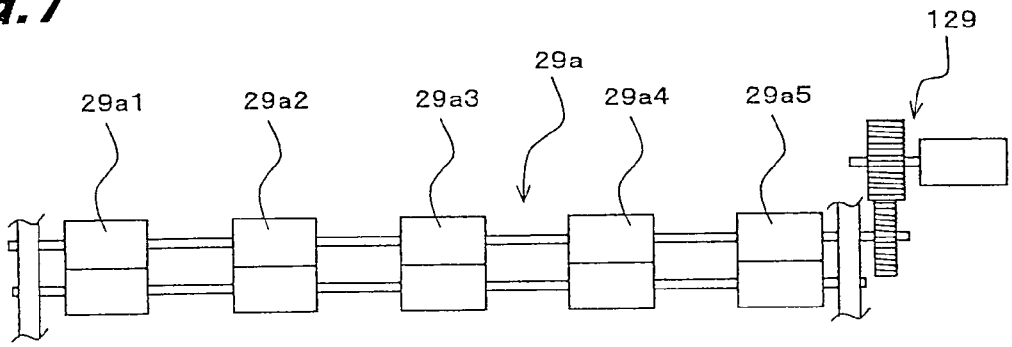
FIG. 7 is a schematic diagram showing one example of the inversion roller configuration.

FIG. 4 is a schematic diagram showing a configuration of one example of a paper conveyance path for the image forming apparatus according to the present embodiment; FIG. 5 is a side view showing a first curved part and inversion rollers in the paper conveyance path; FIG. 6 is a side view showing a second curved part and inversion rollers in the paper conveyance path; and FIG. 7 is a schematic diagram showing one example of the configuration of the inversion roller.

As shown in FIG. 4, the paper conveyance path in image forming apparatus 1 is mainly comprised of paper feed path 25 for feeding the paper upwards from paper feed cassette 23 arranged at the bottom of the machine to image forming portion 10; main conveyance path 16 for conveying the paper from image forming portion 10 to paper discharge drive roller 18 by way of fixing unit 30; paper discharge path 17 for conveying the paper from paper discharge drive roller 18 to paper discharge roller 19; and sub conveyance path 28 for inverting paper P by driving paper discharge roller 19 in reverse to switch back the paper using inversion roller 29.

Paper feed path 25 is extended approximately linearly but gently curved, from a separation roller 25*a* which separates the paper, sheet by sheet if double or multiple sheets of paper are fed and is located on the downstream side of paper pickup roller 24 with respect to the paper's direction of conveyance, to registration roller 26 arranged in the vicinity of the lower side (the upstream side with respect to the paper's direction of conveyance) of photoreceptor drum 11 of image forming portion 10.

Main conveyance path 16 is formed approximately linearly from the downstream side of registration roller 26 to fixing unit 30 by way of image forming portion 10, and is followed by a curved part 16*a* that bends smoothly extending approximately upward from the exit side (the downstream side with respect to the paper's direction of conveyance) of fixing unit 30 toward paper discharge drive roller 18 (to the left in the drawing).

Paper discharge path 17 is extended approximately linearly between paper discharge drive roller 18 and paper discharge roller 19. Paper discharge drive roller 18 is composed of a first conveyance roller 18*a* for conveying the paper into paper discharge path 17 and a second conveyance roller 18*b* that is arranged at a position halfway along paper discharge path 17. However, the configuration of paper discharge drive roller 18 is not limited to this.

In order to invert paper P by driving paper discharge roller 19 in reverse to switch back the paper, sub conveyance path 28 is connected to curved part 16*a* of main conveyance path 16 so that paper P can be guided by paper path switching gate 27 toward inversion roller 29 and further conveyed downwards to the bottom of the apparatus and delivered once again to registration roller 16.

Specifically, sub conveyance path 28 includes a first sub curved part 28*a* for deflecting the direction of movement of paper P that is conveyed in reverse from paper discharge path 17 towards the bottom of the machine and a second curved part 28*b* for deflecting the direction of movement of paper P that is conveyed around the bottom of the machine towards the registration roller 26.

Here, a multiple number of inversion rollers 29 are provided in sub conveyance path 28. That is, a first inversion roller 29*a* and a second inversion roller 29*b* are arranged across the first curved part 28*a* on the upstream and downstream sides, respectively with respect to the paper's direction of conveyance. Further, a third inversion roller 29*c* and a fourth inversion roller 29*d* are arranged across the second curved part 28*b* on the upstream and downstream sides, respectively with respect to the paper's direction of conveyance.

These inversion rollers 29 are controlled such that, in the first curved part 28*a*, the rotating speed V2 of second inversion roller 29*b* is higher than the rotating speed V1 of first inversion roller 29*a*, as shown in FIG. 5, and that in the second curved part 28*b*, the rotating speed V4 of fourth inversion roller 29*d* is higher than the rotating speed V3 of third inversion roller 29*c*, as shown in FIG. 6.

Each inversion roller 29 (29*a*) is composed of separate roller pieces 29*a*1 to 29*a*5 arranged in the direction perpendicular to the paper's direction of conveyance (in the direction along the axial direction of the roller), as shown in FIG. 7.

A reference numeral 129 in the drawing designates a drive mechanism made up of a motor, gears etc. for driving the inversion roller 29.

Here, FIG. 7 shows the configuration of first inversion roller 29*a* of the multiple inversion rollers 29. Each of the second to fourth inversion rollers 29*b* to 29*d* should also have the same configuration as the first inversion roller 29*a*, or have the configuration made up of multiple separate roller pieces.

First curved part 28*a* is composed of curved outer and inner paper guides 28*a*1 and 28*a*2, and second curve part 28*b* is composed of curved outer and inner paper guides 28*b*1 and 28*b*2.

As shown in FIGS. 5 and 6, inner paper guides 28*a*2 and 28*b*2 of first and second curved parts 28*a* and 28*b* are formed with respective guide ribs (guide components) 128*a* and 128*b* that are curved along the conveyance path which guides paper P in the paper's direction of conveyance.

Guide ribs 218*a* and 128*b* are projectively formed so as to oppose and abut the concave side (the surface that curves inward) of paper P when the paper P being conveyed passes through first curved part 28*a* and second curved part 28*b*.

Now, guide ribs 128*a* formed on first curved part 28*a* will be described in detail by an example with drawings.

Figure 8:
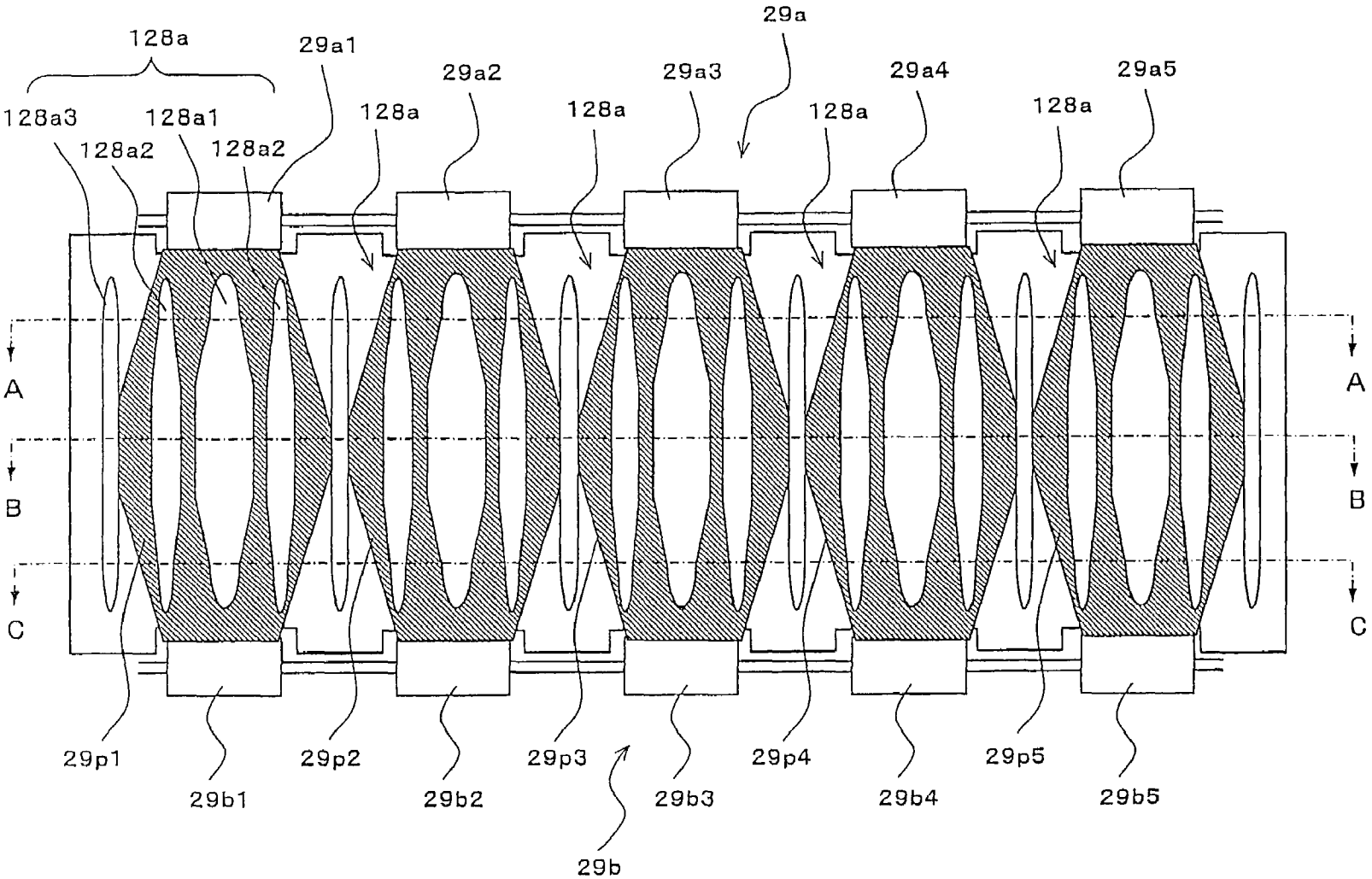
FIG. 8 is a plan view of the first curved part of the paper conveyance path, showing a guide rib configuration of the curved part.
Figure 9A:
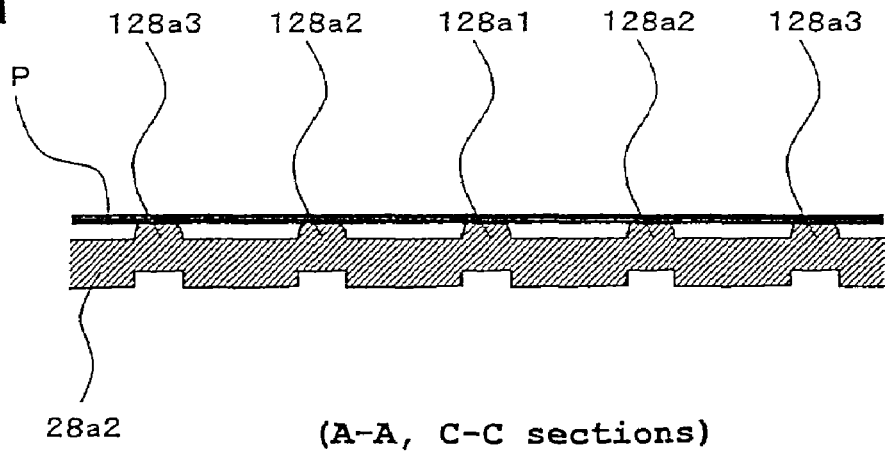
FIG. 9A is a sectional view cut along a line A-A or line C-C in FIG. 8.
Figure 9B:
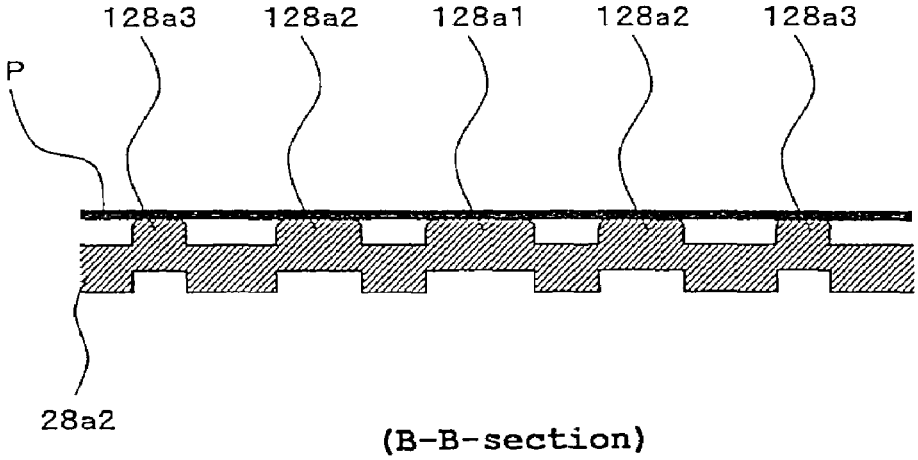
FIG. 9B is a sectional view cut along a line B-B in FIG. 8.

FIG. 8 is a plan view of development of the curved part, showing the configuration of guide ribs of the first curved part of the present embodiment, FIG. 9A is a sectional view cut along a line A-A or line C-C in FIG. 8 and FIG. 9B is a sectional view cut along a line B-B in FIG. 8.

As shown in FIG. 8, guide ribs 128*a* are formed correspondingly to portions 29*p*1to 29*p*5 (portions with hatching) where stress concentrations arise across the paper P that is held between inversion roller pieces 29*a*1 to 29*a*5 of first inversion roller 29*a* and roller pieces 29*b*1 to 29*b*5 of second inversion roller 29*b* and conveyed thereby, in such a manner that multiple guide ribs 128*a*1, 128*a*2 and 128*a*3 are arranged approximately parallel to each other along the paper's direction of conveyance.

Each guide rib 128*a*1 is formed along a line located at the approximate center of the area that is defined between a pair of inversion roller pieces of multiple paired inversion roller pieces 29*a*1 and 29*b*1, 29*a*2 and 29*b*2, 29*a*3 and 29*b*3, 29*a*4 and 29*b*4, and 29*a*5 and 29*b*5, which are opposed to each other.

Because stress concentration on the paper being conveyed becomes greater at the approximate center, with respect to the axes of the rollers, in the area between the paired roller pieces, e.g., 29*a*1 and 29*b*1, guide rib 128*a*1 is formed to be widest with respect to the axial direction of the rollers.

A pair of guide ribs 128*a*2 are formed on both sides along each guide rib 128*a*1, on the lines connected between the ends of each of inversion roller pieces 29*a*1-29*a*5 and the ends of the corresponding inversion roller piece 29*b*1-29*b*5, with respect to the axial direction of each roller piece.

Because stress concentration on the recording medium being conveyed becomes smaller at the aforementioned lines between inversion roller pieces 29*a*1-29*a*5 and 29*b*1-29*b*5 at their associated ends, guide rib 128*a*2 is formed to be narrower than that of guide rib 128*a*1, with respect to the axial direction of the rollers.

Guide ribs 128*a*3 are formed on the outer sides of guide ribs 128*a*1 and 128*a*2, at positions not opposing inversion roller pieces 29*a*1 to 29*a*5 and 29*b*1 to 29*b*5.

Because stress concentration on the recording medium being conveyed becomes smaller at the positions not opposing inversion roller pieces 29*a*1-29*a*5 and 29*b*1-29*b*5, guide rib 128*a*3 is formed to be narrower than that of guide rib 128*a*2, with respect to the axial direction of the rollers. In the present embodiment, the width of guide rib 128*a*3 is formed to be the smallest.

For the aforementioned guide ribs 128*a*1, 128*a*2 and 128*a*3, each rib on the curved portion along the paper's direction of conveyance is formed to be widest in the middle of the curve (at the center with respect to the direction of conveyance) (on the line B-B in the drawing) as shown in FIG. 9B while the width is made smaller toward the ends of the curve (at both ends with respect to the direction of conveyance) (on the lines A-A and C-C in the drawing) as shown in FIG. 9A.

This configuration makes it possible for guide ribs 128*a*1, 128*a*2 and 128*a*3 to bear the paper P with broader abutment around the areas where stress concentration is greater, to thereby disperse stress, prevent concentration of stress acting on paper P and make the stretching stress uniform.

Also for second curved part 28*b*, guide ribs 128*b* (FIG. 6) are formed in the same configurations as the above-described guide ribs 128*a*1, 128*a*2 and 128*a*3.

Also for curved part 16*a* of main conveyance path 16, guide ribs are formed in the same configurations as the above-described guide ribs 128*a*1, 128*a*2 and 128*a*3.

Next, the operation of the paper conveyance path in the image forming apparatus according to the present invention will be described in detail with an example.

Figure 10A:
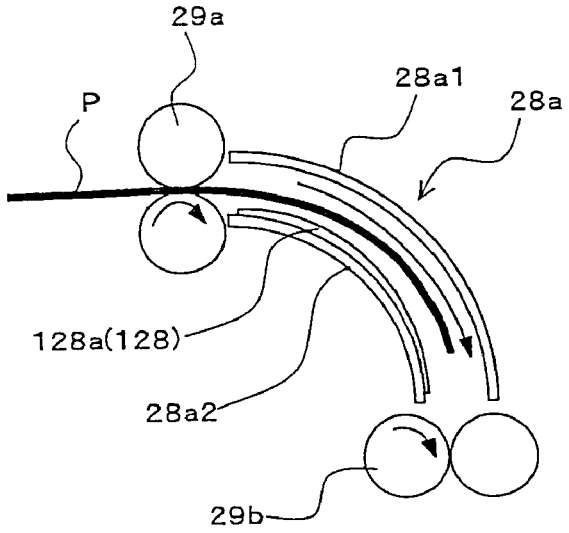
FIG. 10A is an illustrative view showing a state in which the paper is conveyed through the first curved part in the paper conveyance path by the first inversion roller.
Figure 10B:
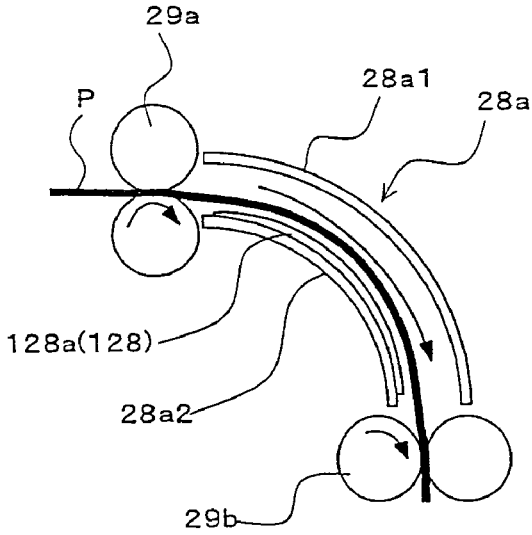
FIG. 10B is an illustrative view showing a state in which the paper is conveyed through the first curved part by the first and second inversion rollers (in the first half of paper conveyance by the two inversion rollers)
Figure 10C:
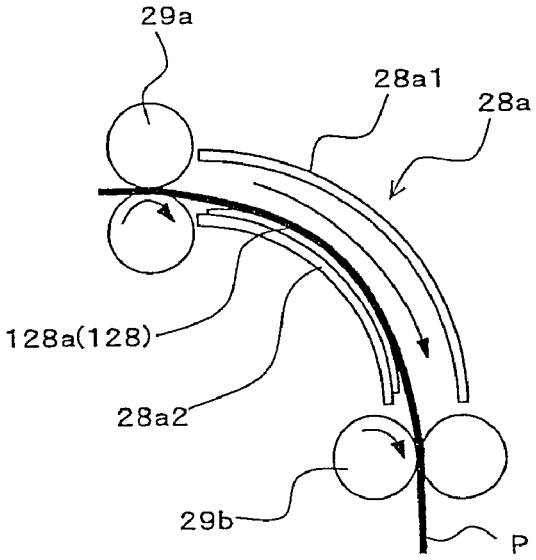
FIG. 10C is an illustrative view showing a state in which the paper is conveyed through the first curved part by the first and second inversion rollers (in the second half of paper conveyance by the two inversion rollers); and, FIG. 10D is an illustrative view showing a state in which the paper is conveyed through the first curved part by the second inversion roller.
Figure 10D:
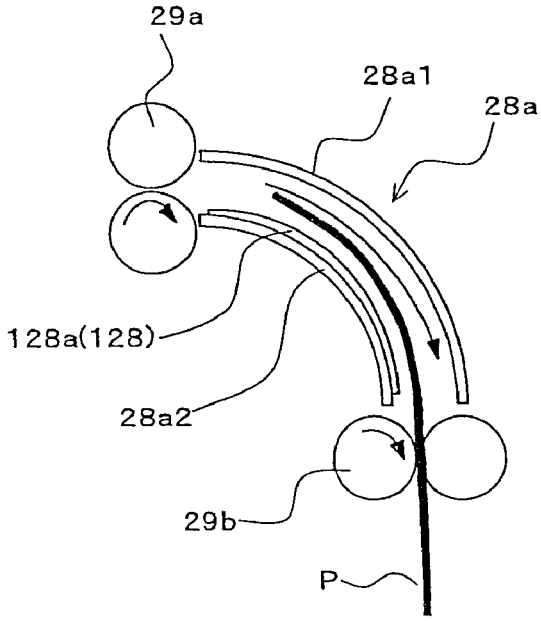

FIGS. 10A to 10D show paper's states of conveyance through the paper conveyance path for the image forming apparatus according to the present embodiment; FIG. 10A is an illustrative view showing a state in which the paper is conveyed through the first curved part in the paper conveyance path by the first inversion roller; FIG. 10B is an illustrative view showing a state in which the paper is conveyed through the first curved part by the first and second inversion rollers (in the first half of paper conveyance by the two inversion rollers); FIG. 10C is an illustrative view showing a state in which the paper is conveyed through the first curved part by the first and second inversion rollers (in the second half of paper conveyance by the two inversion rollers); and FIG. 10D is an illustrative view showing a state in which the paper is conveyed through the first curved part by the second inversion roller.

When duplex printing is performed in image forming apparatus 1, the paper P's direction of conveyance is inverted by switchback control so that the paper is conveyed from paper discharge path 17 to sub conveyance path 28, as shown in FIG. 4.

In sub conveyance path 28, the paper P's direction of conveyance as it is conveyed through first curved part 28*a* is deflected from the horizontal direction to the downward direction.

When paper P is conveyed through first curved part 28*a*, first, the paper enters first curved part 28*a* with its leading end held by first inversion rollers 29*a* as shown in FIG. 10A. The paper P that has entered first curved part 28*a* is further conveyed while its leading end, being free, is guided downward along outer paper guide 28*a*1 to be conveyed into second inversion rollers 29*b*.

The paper P that has arrived at second inversion roller 29*b* is conveyed with its leading end held by second inversion roller 29*b*. That is, the paper is conveyed out of first curved part 28*a* by first inversion rollers 29*a* and second inversion rollers 29*b*, as shown in FIG. 10B.

At the beginning of conveyance by second inversion roller 29*b*, paper P has not yet been in contact with guide rib 128*a* or has not received any strong tension due to conveyance even if it is in contact therewith.

As the paper P is further conveyed by second inversion roller 29*b*, since it is so controlled that rotational speed V2 of second inversion roller 29*b* becomes larger than rotational speed V1 of first inversion roller 29*a* as shown in FIG. 10C, paper P is tightened by second inversion roller 29*b* so that the paper is conveyed whilst it is pressed against guide ribs 128*a*.

Since guide ribs 128*a*1 (FIG. 8) are adapted to abut the areas on which stress, arising when the paper P is pressed against guide ribs 128*a* by the tension during paper conveyance, concentrates between first inversion roller 29*a* and second inversion roller 29*b*, the stress can be dispersed by guide ribs 128*a*1 with broader width.

On the other hand, areas on which a lower stress concentrates between first inversion roller 29*a* and second inversion roller 29*b* are received by guide ribs 128*a*2 (FIG. 8), the stress can be dispersed by guide ribs 128*a*2 with narrower width.

In this way, provision of a multiple number of guide ribs 128*a* differentiated in size depending on the magnitude and areas of the stress acting on paper P makes it possible to uniformly disperse the stress that acts on paper P.

As paper P is further conveyed by second inversion roller 29*b*, the rear end of paper P passes by first inversion roller 29*a* so that the paper is conveyed by second inversion roller 29*b* alone, as shown in FIG. 10D. In this condition, since the rear end of paper P is freed, the tensile force that acted on paper P no longer exists, so that paper P is conveyed freely without being abutted against guide ribs 128.

Also in second curved part 28*b*, since paper conveyance and operation are done in the same manner as in the aforementioned first curved part 28*a*, stress acting on the conveyed paper P can be dispersed.

According to the present embodiment thus configured, curved parts 28*a* and 28*b* of sub conveyance path 28 are formed with guide ribs 128 so that stress acting on paper P when in contact will not concentrate at local areas. Accordingly, it is possible to disperse stress concentration arising during conveyance of paper P, hence it is possible to suppress degradation of print quality due to rubbing between guide ribs 128 and the paper P being conveyed after image information has been fixed thereon as well as to prevent skew and jamming during paper conveyance, thus achieving correct paper conveyance.

Further, according to the present embodiment, inversion rollers 29*a* and 29*b* are formed of multiple roller pieces 29*a*1 to 29*a*5 or 29*b*1 to 29*b*5, which are separated in the axial direction while guide ribs 128 (128*a*1, 128*a*2 and 128*a*3) are formed correspondingly to the separate roller pieces 29*a*1 to

29*a*5 and 29*b*1 to 29*b*5. Accordingly, the stress generated across the paper P by the separate roller pieces can be dispersed, hence the rubbing phenomenon can be suppressed to thereby achieve more stable paper conveyance.

Though in the present embodiment and in the example, the paper conveyance path configuration has been explained by using sub conveyance path 28 as an example, the paper conveyance path of the present invention should not be particularly limited. For example, curved part 16*a* (FIG. 4) of main conveyance path 16 in the present embodiment may have a similar configuration and produce the same effect.

Further, in the example of the present embodiment, guide ribs 128 are formed with three kinds of guide ribs 128*a*1, 128*a*2 and 128*a*3. However, the present invention should not be limited by the types and number of guide ribs. The shapes and number of guide ribs can be determined as appropriate depending on the paper conveyance path configuration and the arrangement of conveying rollers and inversion rollers, so that development can be made in correspondence with each apparatus configuration.

Finally, though in the present embodiment three kinds of guide ribs 128*a*1, 128*a*2 and 128*a*3 are used in combination to constitute guide ribs 128, the present invention should not limited to this. For example, it is also possible to develop a configuration in which the shape, width and the number of the guide ribs can be modified depending on the paper size.

What is claimed is:

1. An image forming apparatus comprising:

a recording medium container for holding a multiple number of recording mediums;

a recording medium feeder for delivering the recording mediums, sheet by sheet, from the recording medium container;

an image forming portion for transferring a developer image formed with a developer to the recording medium;

a fixing portion for fusing and fixing the developer image transferred to the recording medium onto the recording medium by a heated fixing roller;

a paper discharge portion for discharging the recording medium with the developer image fused and fixed thereon to the outside of the apparatus; and a recording medium conveying portion for conveying the recording medium along a recording medium conveyance path by conveyance rollers, wherein the recording medium conveyance path is formed with guide components for guiding the conveyed recording medium in the recording medium's direction of conveyance;

the guide components are provided at least inside a curved part of the recording medium conveyance path;

the guide components are formed in shapes that will not cause concentration of stress acting on the recording medium in abutment therewith; and at least one of the guide components is constructed such that, as to the configuration in the width direction that is perpendicular to the recording medium's direction of conveyance and parallel to an axial direction of the conveyance rollers, a section of the at least one guide component is formed to be wider at an area where a greater concentration of stress acts on the recording medium being conveyed while a section of the at least one guide component is formed to be narrower at an area where a less concentration or stress acts on the recording medium being conveyed.

2. The image forming apparatus according to claim 1, wherein the recording medium conveying portion includes conveyance rollers arranged across the guide components, on the upstream and downstream sides thereof, with respect to the recording medium's direction of conveyance, and the two conveyance rollers are arranged at such positions as to be able to hold and convey the recording medium at the same time.

3. The image forming apparatus according to claim 1, wherein the guide component is constructed such that, as to the configuration in the width direction that is perpendicular to the recording medium's direction of conveyance, a section of the guide component is formed to be wider at an area where a greater concentration of stress acts on the recording medium being conveyed while a section of guide component is formed to be narrower at an area where a less concentration of stress acts on the recording medium being conveyed.

4. The image forming apparatus according to claim 1, wherein the guide component provided inside the curved part of the recording medium conveyance path is formed so that it is formed to be wider in the middle portion of the curved part with respect to the recording medium's direction of conveyance while it is formed to be narrower in the distal ends of the curved part with respect to the recording medium's direction of conveyance.

5. The image forming apparatus according to claim 1, wherein the conveyance roller is composed of a multiple number of conveyance roller pieces, separated with respect to the direction perpendicular to the recording medium's direction of conveyance, and the guide components are disposed correspondingly to the separated conveyance roller pieces.

6. The image forming apparatus according to claim 1, wherein the guide components are arranged in a curved part of the recording medium conveyance path between the fixing portion and the paper discharge portion.

7. The image forming apparatus according to claim 1, having a duplex printing function, and further including:

as a component of the recording medium conveyance path a sub conveyance path for conveying the recording medium by switchback control when duplex printing is performed, characterized in that the sub conveyance path is extended from the fixing portion to the image forming portion; and the guide components are arranged in a curved part of the sub conveyance path.

8. The image forming apparatus according to claim 2, wherein the guide component provided inside the curved part of the recording medium conveyance path is formed so that it is formed to be wider in the middle portion of the curved part with respect to the recording medium's direction of conveyance while it is formed to be narrower in the distal ends of the curved part with respect to the recording medium's direction of conveyance.

9. The image forming apparatus according to claim 3, wherein the guide component provided inside the curved part of the recording medium conveyance path is formed so that it is formed to be wider in the middle portion of the curved part with respect to the recording medium's direction of conveyance while it is formed to be narrower in the distal ends of the curved part with respect to the recording medium's direction of conveyance.

10. The image forming apparatus according to claim 2, wherein the conveyance roller is composed of a multiple number of conveyance roller pieces, separated with respect to the direction perpendicular to the recording medium's direction of conveyance, and the guide components are disposed correspondingly to the separated conveyance roller pieces.

11. The image forming apparatus according to claim 3, wherein the conveyance roller is composed of a multiple number of conveyance roller pieces, separated with respect to the direction perpendicular to the recording medium's direction of conveyance, and the guide components are disposed correspondingly to the separated conveyance roller pieces.

12. The image forming apparatus according to claim 4, wherein the conveyance roller is composed of a multiple number of conveyance roller pieces, separated with respect to the direction perpendicular to the recording medium's direction of conveyance, and the guide components are disposed correspondingly to the separated conveyance roller pieces.

13. The image forming apparatus according to claim 2, wherein the guide components are arranged in a curved part of the recording medium conveyance path between the fixing portion and the paper discharge portion.

14. The image forming apparatus according to claim 3, wherein the guide components are arranged in a curved part of the recording medium conveyance path between the fixing portion and the paper discharge portion.

15. The image forming apparatus according to claim 4, wherein the guide components are arranged in a curved part of the recording medium conveyance path between the fixing portion and the paper discharge portion.

16. The image forming apparatus according to claim 5, wherein the guide components are arranged in a curved part of the recording medium conveyance path between the fixing portion and the paper discharge portion.

17. The image forming apparatus according to claim 2, having a duplex printing function, and further including:

as a component of the recording medium conveyance path a sub conveyance path for conveying the recording medium by switchback control when duplex printing is performed, characterized in that the sub conveyance path is extended from the fixing portion to the image forming portion; and the guide components are arranged in a curved part of the sub conveyance path.

18. The image forming apparatus according to claim 3, having a duplex printing function, and further including:

as a component of the recording medium conveyance path a sub conveyance path for conveying the recording medium by switchback control when duplex printing is performed, characterized in that the sub conveyance path is extended from the fixing portion to the image forming portion; and the guide components are arranged in a curved part of the sub conveyance path.

19. The image forming apparatus according to claim 4, having a duplex printing function, and further including:

as a component of the recording medium conveyance path a sub conveyance path for conveying the recording medium by switchback control when duplex printing is performed, characterized in that the sub conveyance path is extended from the fixing portion to the image forming portion; and the guide components are arranged in a curved part of the sub conveyance path.

20. The image forming apparatus according to claim 5, having a duplex printing function, and further including:

as a component of the recording medium conveyance path a sub conveyance path for conveying the recording medium by switchback control when duplex printing is performed, characterized in that the sub conveyance path is extended from the fixing portion to the image forming portion; and the guide components are arranged in a curved part of the sub conveyance path.

21. The image forming apparatus according to claim 6, having a duplex printing function, and further including:

as a component of the recording medium conveyance path a sub conveyance path for conveying the recording medium by switchback control when duplex printing is performed, characterized in that the sub conveyance path is extended from the fixing portion to the image forming portion; and the guide components are arranged in a curved part of the sub conveyance path.

* * * * *